US010913638B2

(12) United States Patent
Yin et al.

(10) Patent No.: US 10,913,638 B2
(45) Date of Patent: Feb. 9, 2021

(54) DEVICE FOR FIXING GANTRY CRANE RAILS IN FACTORY BUILDINGS AND GANTRY CRANE SYSTEM USING THE SAME

(71) Applicant: RUENTEX ENGINEERING & CONSTRUCTION CO., LTD., Taipei (TW)

(72) Inventors: Samuel Yin, Taipei (TW); Pin-Pin Teng, Taipei (TW)

(73) Assignee: RUENTEX ENGINEERING & CONSTRUCTON, CO., LTD., Taipei (TW)

( * ) Notice: Subject to any disclaimer, the term of this patent is extended or adjusted under 35 U.S.C. 154(b) by 596 days.

(21) Appl. No.: 15/810,715

(22) Filed: Nov. 13, 2017

(65) Prior Publication Data

US 2019/0062128 A1 Feb. 28, 2019

(30) Foreign Application Priority Data

Aug. 31, 2017 (TW) ..... 106129682 A

(51) Int. Cl.

| | |
|---|---|
| ***B66C 7/04*** | (2006.01) |
| ***B66C 17/00*** | (2006.01) |
| ***B66C 6/00*** | (2006.01) |
| ***B66C 7/08*** | (2006.01) |

(52) U.S. Cl.

CPC ..... *B66C 7/04* (2013.01); *B66C 6/00* (2013.01); *B66C 7/08* (2013.01); *B66C 17/00* (2013.01)

(58) Field of Classification Search

CPC .. B66C 7/04; B66C 7/08; B66C 17/00; B66C 6/00

USPC ..... 212/312, 324

See application file for complete search history.

(56) References Cited

U.S. PATENT DOCUMENTS 462,637 A * 11/1891 Graves ..... B61C 11/04 105/29.1
672,788 A * 4/1901 Lieber et al. ..... C23G 3/00 134/164
1,712,650 A * 5/1929 Clark ..... B66C 13/00 340/471

(Continued)

FOREIGN PATENT DOCUMENTS

| | | |
|---|---|---|
| CN | 205634682 | 10/2016 |
| CN | 206407826 U | 8/2017 |
| JP | 2000233888 A | 8/2000 |

OTHER PUBLICATIONS

Chinese Office Action and Search Report dated Mar. 13, 2020, in Chinese counterpart application 201710767728.0, 6 pages in Chinese.

*Primary Examiner* — Zachary L Kuhfuss

(74) *Attorney, Agent, or Firm* — Juan Carlos A. Marquez; Marquez IP Law Office, PLLC

(57) ABSTRACT

The present disclosure provides a device for fixing a gantry crane rail in a factory building and a gantry crane system using the same. The device comprises a main body, which comprises a top portion, a first surface and a second surface opposite the first surface. The top portion is fixed to a bottom surface of a beam of the factory building, and the first surface and the second surface are substantially parallel to the crane rail. The device further comprises a first protruded support positioned on the first surface and a second protruded support positioned on the second surface.

10 Claims, 9 Drawing Sheets

(56) References Cited

U.S. PATENT DOCUMENTS

| | | | | | |
|---|---|---|---|---|---|
| 1,840,327 | A * | 1/1932 | Paulsen | F27D 3/06 | 414/191 |
| 2,496,209 | A * | 1/1950 | Hemming | B66C 13/54 | 454/119 |
| 3,339,753 | A * | 9/1967 | Forster | B66C 7/00 | 212/312 |
| 3,517,830 | A * | 6/1970 | Virkkala | B66C 13/063 | 212/275 |
| 3,891,094 | A * | 6/1975 | Angus | B66C 11/00 | 212/312 |
| 4,502,527 | A * | 3/1985 | Brewer | B22D 47/00 | 164/412 |
| 4,561,551 | A * | 12/1985 | Goussinsky | B66C 9/14 | 212/223 |
| 4,641,757 | A * | 2/1987 | Rosendale | B66C 9/00 | 104/182 |
| 4,717,030 | A * | 1/1988 | Ebata | F01D 25/285 | 212/271 |
| 5,133,465 | A * | 7/1992 | Kalan | B66C 13/22 | 212/276 |
| 7,066,094 | B2 | 6/2006 | Moutsokapas et al. | | |
| 9,970,210 | B2 * | 5/2018 | Onishi | F01K 13/00 | |
| 10,495,880 | B2 * | 12/2019 | Rantala | G02B 27/017 | |
| 2002/0112441 | A1 * | 8/2002 | Bissen | E04G 21/0427 | 52/834 |
| 2008/0302033 | A1 * | 12/2008 | Insalaco | B66C 7/04 | 52/220.2 |
| 2010/0170865 | A1 * | 7/2010 | Kundel, Sr. | E04C 3/083 | 212/175 |
| 2019/0062128 | A1 * | 2/2019 | Yin | B66C 17/00 | |

* cited by examiner

DEVICE FOR FIXING GANTRY CRANE RAILS IN FACTORY BUILDINGS AND GANTRY CRANE SYSTEM USING THE SAME

TECHNICAL FIELD

The present disclosure relates to devices for fixing gantry crane rails in factory buildings and gantry crane systems using the same.

BACKGROUND

Nowadays, hybrid construction methods (e.g., the pre-casting construction method) are widely used in the construction of large-scale buildings in order to increase construction efficiency and to have better control of the construction schedule. In the pre-casting construction method, most of the work items that used to be carried out at the construction site (including the manufacturing of the main components such as beams, pillars, floors and so on) are carried out in a factory. Only a few work items (e.g., assembly of components, reinforcement of steel bars, and concrete pouring) are carried out at the construction site, and thus the amount of on-site work can be significantly reduced.

If the pre-casting construction method is used to construct a building, the beams, pillars and floors manufactured in the factory need to be transported to the construction site using means such as trailers or trucks. These components will then be transported to specified locations within the building according to the structure of the building. In large-scale buildings, longitudinal beams may be disposed between supporting pillars, and rails are disposed on the longitudinal beams for gantry cranes or other large equipment to run on. Various kinds of components can thus be transported within a building using gantry cranes or other large equipment.

In an existing approach, a supporting base is disposed on each of the supporting pillars on opposite sides of a building, wherein a longitudinal beam is disposed on the supporting bases on two adjacent supporting pillars in the longitudinal direction, and wherein a rail is disposed on the longitudinal beam for gantry cranes to run on. However, as the size of new buildings increases, the distance between two adjacent supporting pillars in the lateral direction increases too, thereby increasing the distance between two supporting bases on two adjacent supporting pillars in the longitudinal direction and that between two adjacent longitudinal beams increases.

Both the length of existing longitudinal beams and the span of existing gantry cranes are usually in line with existing specifications. It is costly or even technically impossible to customize the length of longitudinal beams or the span of gantry cranes for each different building. Therefore, there is a need to develop a device and system for disposing longitudinal beams with flexibility in a building so that existing longitudinal beams and gantry cranes can be used in the construction of large-scale buildings.

SUMMARY

The following summarizes some aspects of the present disclosure to provide a basic understanding of the discussed technology. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a summary form as a prelude to the more detailed description that is presented later.

One of the purposes of the present disclosure is to provide devices for fixing gantry crane rails in factory buildings and gantry crane systems using the same, and to utilize existing longitudinal beams and gantry cranes in factory buildings of different sizes.

In one embodiment of the present disclosure, a device for fixing a gantry crane rail within a factory building comprises: a main body, a first protruded support and a second protruded support. The main body comprises a top portion fixed to a bottom surface of a crossbeam of the factory building, a first surface, and a second surface opposite the first surface. The first surface and the second surface are substantially parallel to the gantry crane rail; the first protruded support is positioned on the first surface and the second protruded support is positioned on the second surface.

In another embodiment of the present disclosure, a gantry crane system used in a factory building comprises a first pillar having a first supporting base; a second pillar having a second supporting base; a first fixing device; a second fixing device; a first longitudinal beam disposed between the first supporting base and the second supporting base; a second longitudinal beam disposed between the first fixing device and the second fixing device; a first rail disposed on the first longitudinal beam; a second rail disposed on the second longitudinal beam; and a gantry crane disposed across the first rail and the second rail; wherein the first longitudinal beam is substantially parallel to the second longitudinal beam.

In a further embodiment of the present disclosure, a gantry crane system used in a factory building comprises: a first pillar having a first supporting base; a first fixing device; a second fixing device; a third fixing device; a first longitudinal beam disposed between the first supporting base and the first fixing device; a second longitudinal beam disposed between the second fixing device and the third fixing device; a first rail disposed on the first longitudinal beam; a second rail disposed on the second longitudinal beam; and a gantry crane disposed across the first rail and the second rail, wherein the first rail is substantially parallel to the second rail.

In a still further embodiment of the present disclosure, a gantry crane system used in a factory building comprises: a first pillar having a first supporting base; a second pillar having a second supporting base; a first fixing device having a first side and a second side opposite the first side; and a second fixing device having a first side and a second side opposite the first side; wherein a surface of the first side of the first fixing device and a surface of the first side of the second fixing device are generally aligned and a surface of the second side of the first fixing device and a surface of the second side of the second fixing device are also generally aligned.

The gantry crane system of the still further embodiment further comprises: a third pillar having a third supporting base; a fourth pillar having a fourth supporting base; a first longitudinal beam disposed between the first supporting base and the second supporting base and comprising a first rail thereon; a second longitudinal beam disposed between the first side of the first fixing device and the first side of the second fixing device and comprising a second rail thereon; a third longitudinal beam disposed between the second side of the first fixing device and the second side of the second fixing device and comprising a third rail thereon; a fourth longitudinal beam disposed between the third supporting base and the fourth supporting base and comprising a fourth rail thereon; a first gantry crane disposed across the first rail and the second rail; and a second gantry crane disposed across the third rail and the fourth rail; wherein the first longitudinal beam, the second longitudinal beam, the third longitudinal beam and the fourth longitudinal beam are substantially parallel to each other.

Other aspects, features, and embodiments of the present disclosure will become apparent to those of ordinary skill in the art, upon reviewing the following description of specific, exemplary embodiments of the present disclosure in conjunction with the accompanying figures. While features of the present disclosure may be discussed relative to certain embodiments and figures below, all embodiments of the present disclosure can include one or more of the advantageous features discussed herein. In other words, while one or more embodiments may be discussed as having certain advantageous features, one or more of such features may also be used in accordance with the various embodiments of the invention discussed herein. In a similar fashion, while exemplary embodiments may be discussed below as device, system, or method embodiments it should be understood that such exemplary embodiments can be implemented in various devices, systems, and methods.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Figure 1:
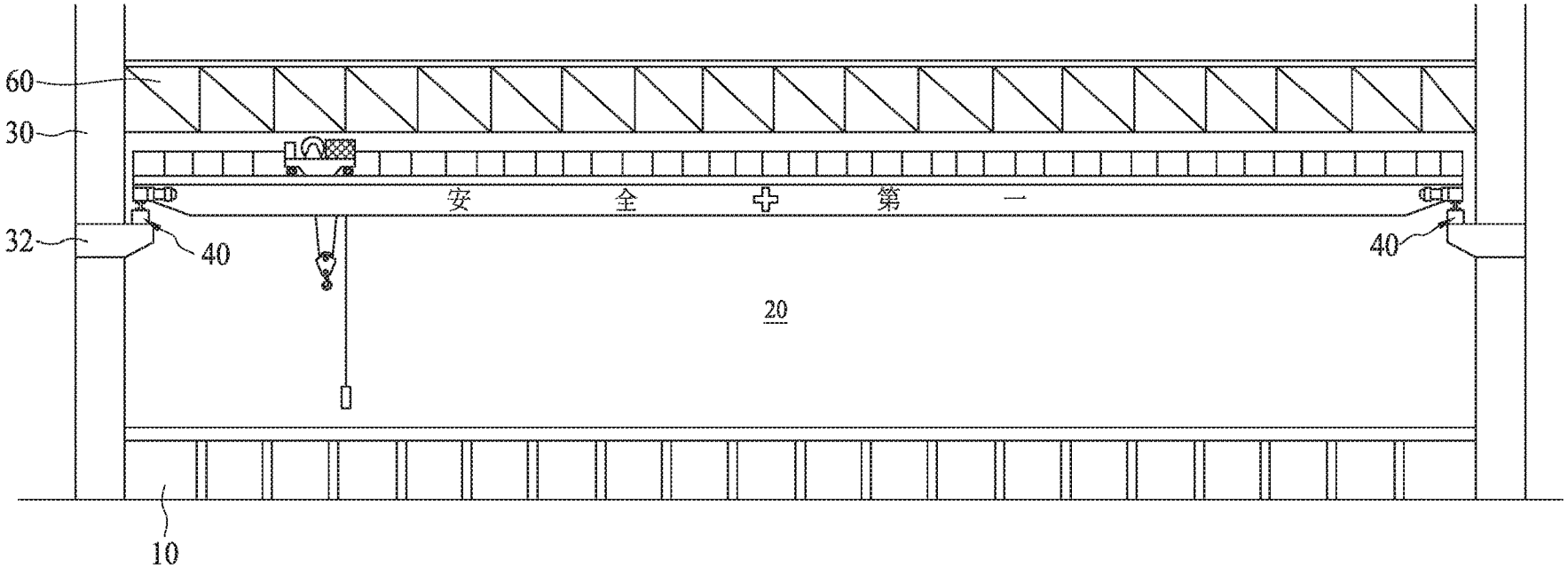
FIG. 1 illustrates the use of a gantry crane within a factory building according to an embodiment of the present disclosure.

FIG. 1 illustrates the use of a gantry crane within a factory building according to an embodiment of the present disclosure. Generally speaking, a factory building takes up more space than a general building because the floors of a factory building are taller than those of a general building. Steel is usually used in constructing the structure of a factory building. Referring to FIG. 1, several pillars 30 are disposed on the ground 10, and floors and a crossbeam 60 are disposed between each of the pillars 30. A transportation channel 20 (in a direction perpendicular to the plan surface of FIG. 1) is included in the inner space of the factory building. Supporting bases 32 are fixed to the pillars 30 on two sides of the transportation channel 20, and longitudinal beams 40 are disposed on the supporting bases 32. Rails 42 are disposed on the longitudinal beams 40 (referring to FIG. 2) and a gantry crane is disposed across two rails 42 of two adjacent pillars 30.

Figure 2:
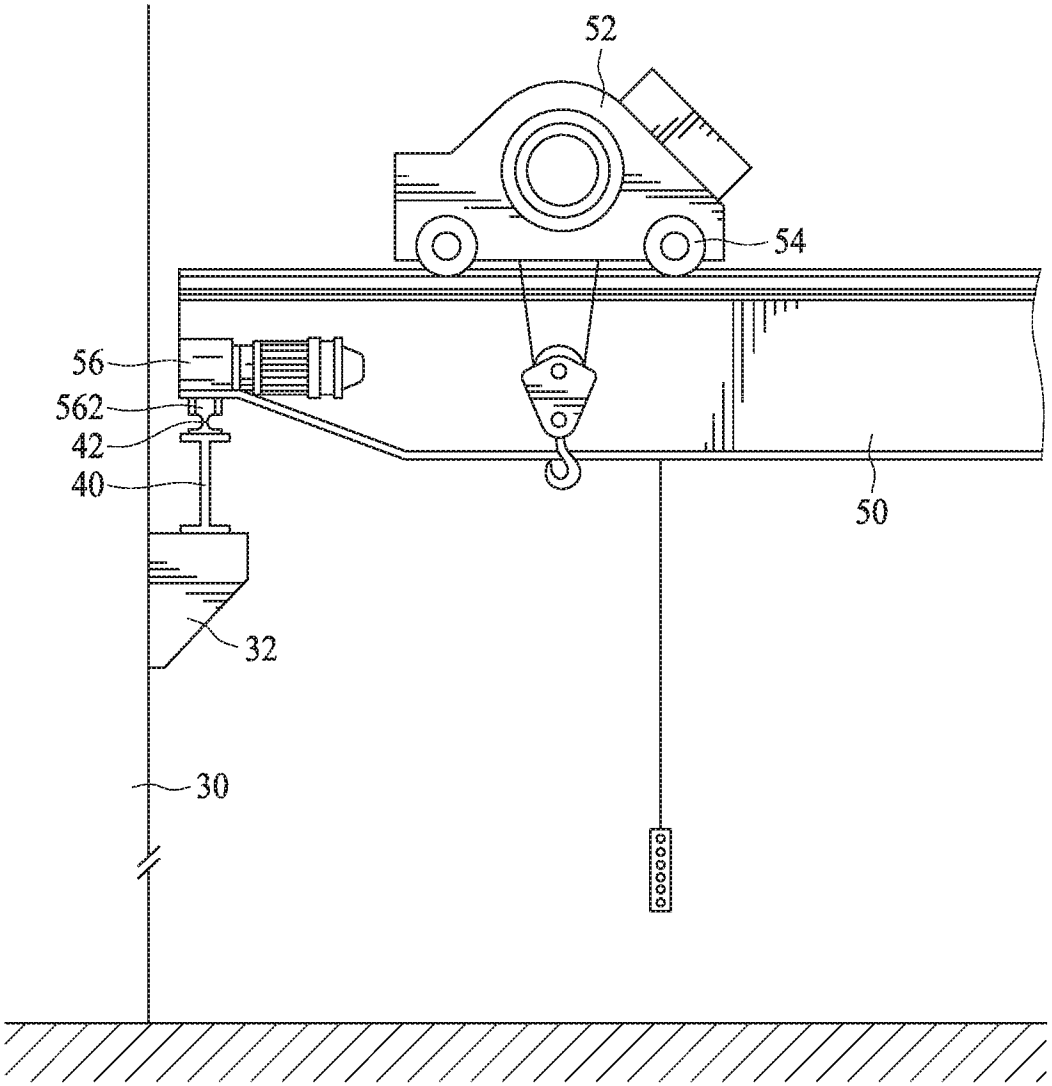
FIG. 2 illustrates a detailed structure of a gantry crane according to an embodiment of the present disclosure.

FIG. 2 illustrates a detailed structure of a gantry crane according to an embodiment of the present disclosure. The gantry crane includes a bearing beam 50 disposed across two rails 42 on two opposite sides of the transportation channel 20. A driving device 56 is disposed on one end of the gantry crane, and a wheel 562 of the driving device 56 is movably disposed on the rail 42; thus, the bearing beam 50 can move within the transportation channel 20 in a longitudinal direction of the factory building. A lifting spreader 52 including a wheel 54 for moving on the bearing beam 50 is disposed on the bearing beam 50. By moving the lifting spreader 52 on the bearing beam 50, various kinds of components lifted by the lifting spreader 52 can be moved in a lateral direction of the factory building.

Figure 3A:
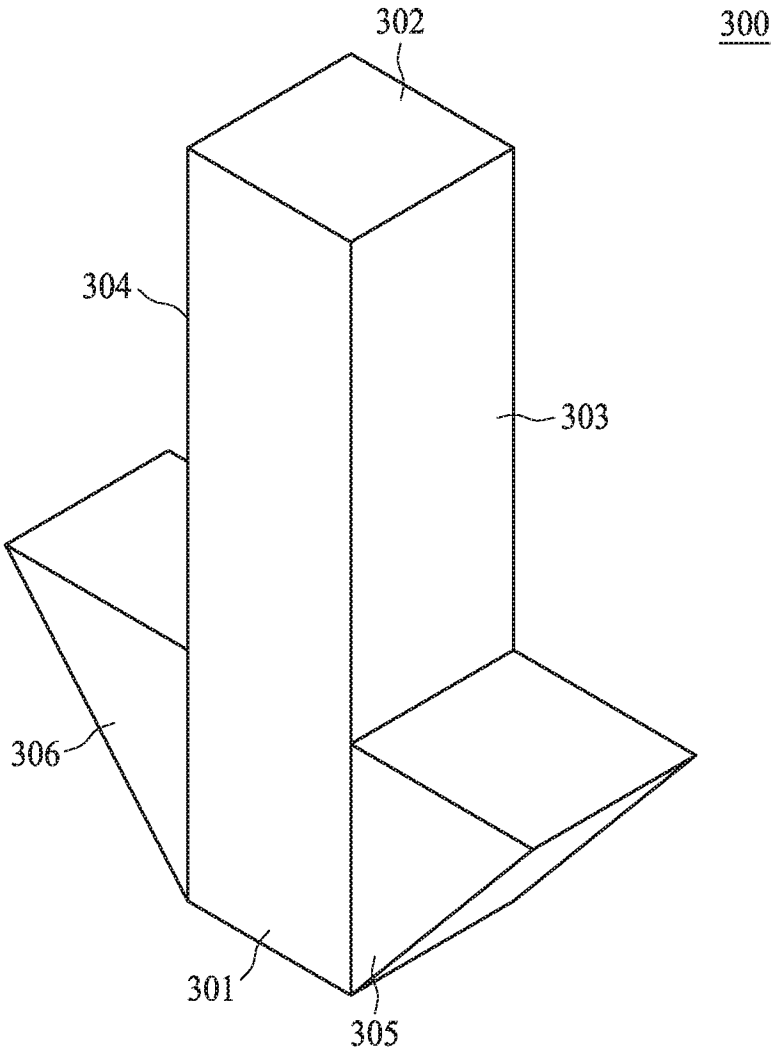
FIG. 3A illustrates a device for fixing a gantry crane rail within a factory building according to an embodiment of the present disclosure.

FIG. 3A illustrates a device for fixing a gantry crane rail within a factory building according to an embodiment of the present disclosure. Referring to FIG. 3A, a fixing device 300 includes a main body 301, a top portion 302, a first surface 303 and a second surface 304 opposite the first surface 303. The fixing device 300 further includes a first protruded support 305 positioned on the first surface 303 and a second protruded support 306 positioned on the second surface 304. In some embodiments, the top portion 302 is fixed to a bottom surface of a beam (for example, a crossbeam 60) by means of welding, and the first surface 303 and the second surface 304 are substantially parallel to the gantry crane rail. In some embodiments, both the first protruded support 305 and the second protruded support 306 are substantially in the shape of a triangular prism. In some embodiments, both the first protruded support 305 and the second protruded support 306 include a flat surface for disposing a rail thereon. In some embodiments, the main body 301 is a solid cuboid. In some embodiments, the main body 301, the first protruded support 305 and the second protruded support 306 are made of metal such as steel.

Figure 3B:
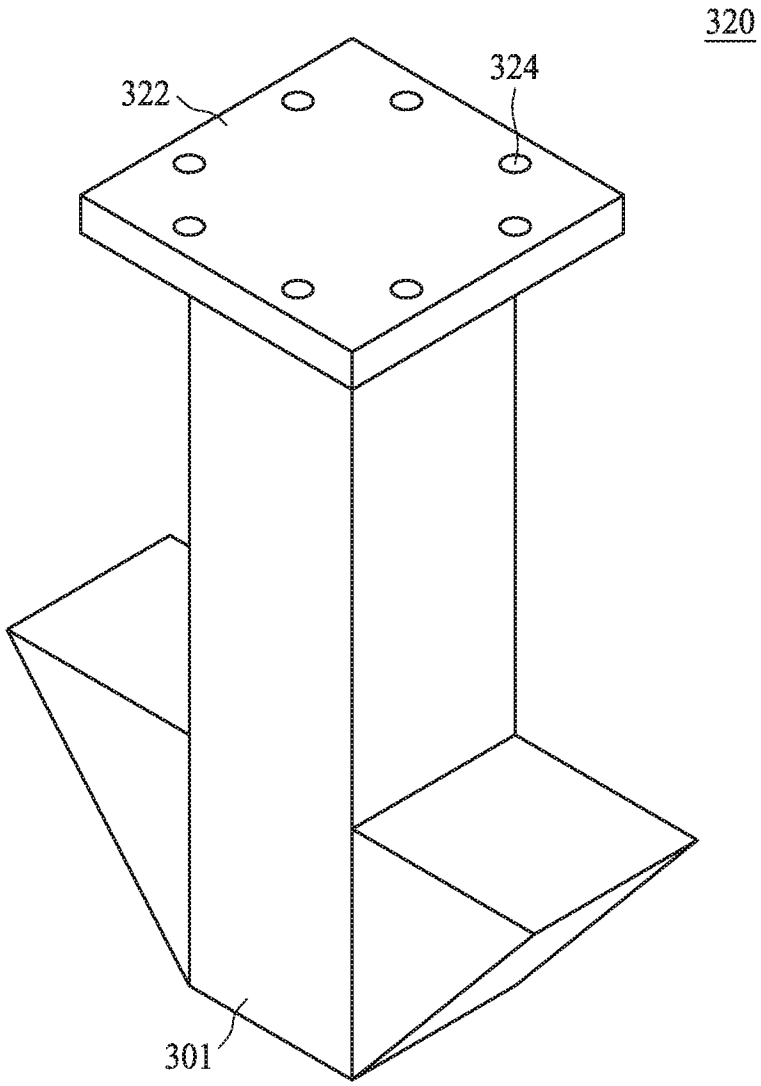
FIG. 3B illustrates a device for fixing a gantry crane rail within a factory building according to an embodiment of the present disclosure.

FIG. 3B illustrates a device for fixing a gantry crane rail in a factory building according to an embodiment of the present disclosure. As shown in FIG. 3B, a fixing device 320 has a structure similar to that of the fixing device 300 shown in FIG. 3A, while the fixing device 320 further includes a fixing plate 322. The fixing plate 322 has a substantially square shape and the area of the fixing plate 322 is larger than that of a cross-section of the main body 301 so that the area of the fixing device 320 that is attached to the bottom surface of a beam is increased, thereby reducing local stress concentration. In some embodiments, the fixing plate 322 includes a plurality of through holes 324 in the periphery regions of the fixing plate 322. In some embodiments, the fixing device 320 is fixed to the bottom surface of a beam (for example, a crossbeam 60) with a plurality of screws or bolts passing through the plurality of through holes 324 and being threadedly connected with threaded holes in the beam.

Figure 3C:
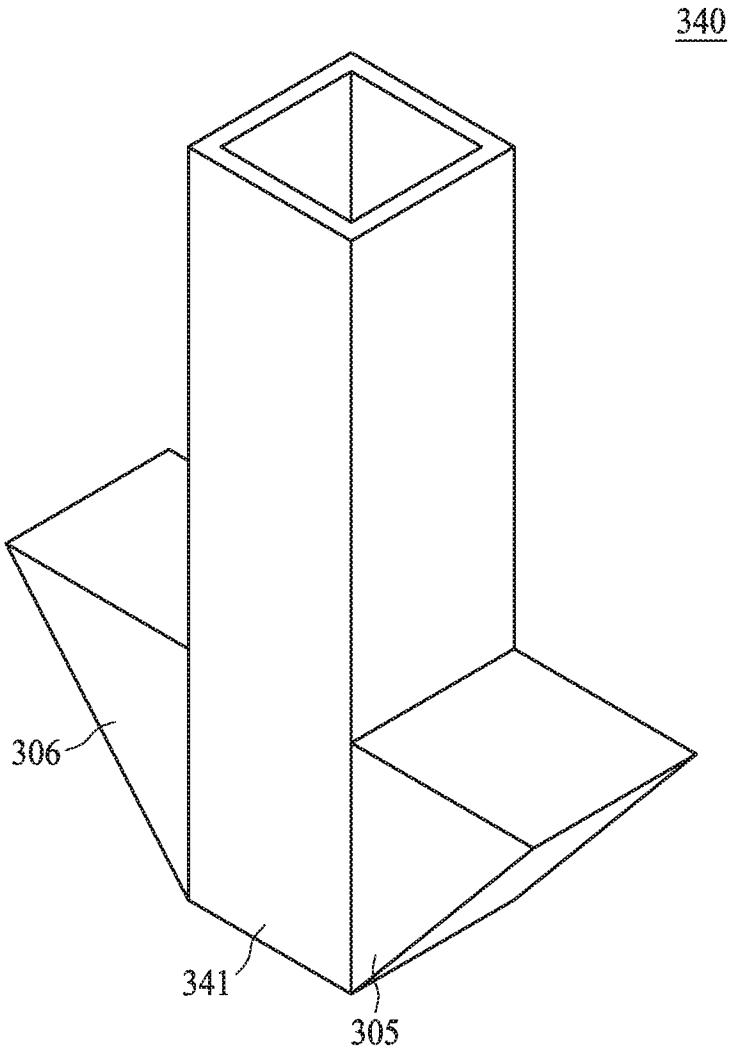
FIG. 3C illustrates a device for fixing a gantry crane rail within a factory building according to an embodiment of the present disclosure.

FIG. 3C illustrates a device for fixing a gantry crane rail in a factory building according to an embodiment of the present disclosure. Referring to FIG. 3C, a fixing device 340 has a structure similar to that of the fixing device 300 shown in FIG. 3A. As shown in FIG. 3C, the main body 341 of the fixing device 340 is a hollow cuboid. In some embodiments, the fixing device 340 may include the fixing plate 322 (not shown in FIG. 3C) having a substantially rectangular or square shape as shown in FIG. 3B.

Figure 3D:
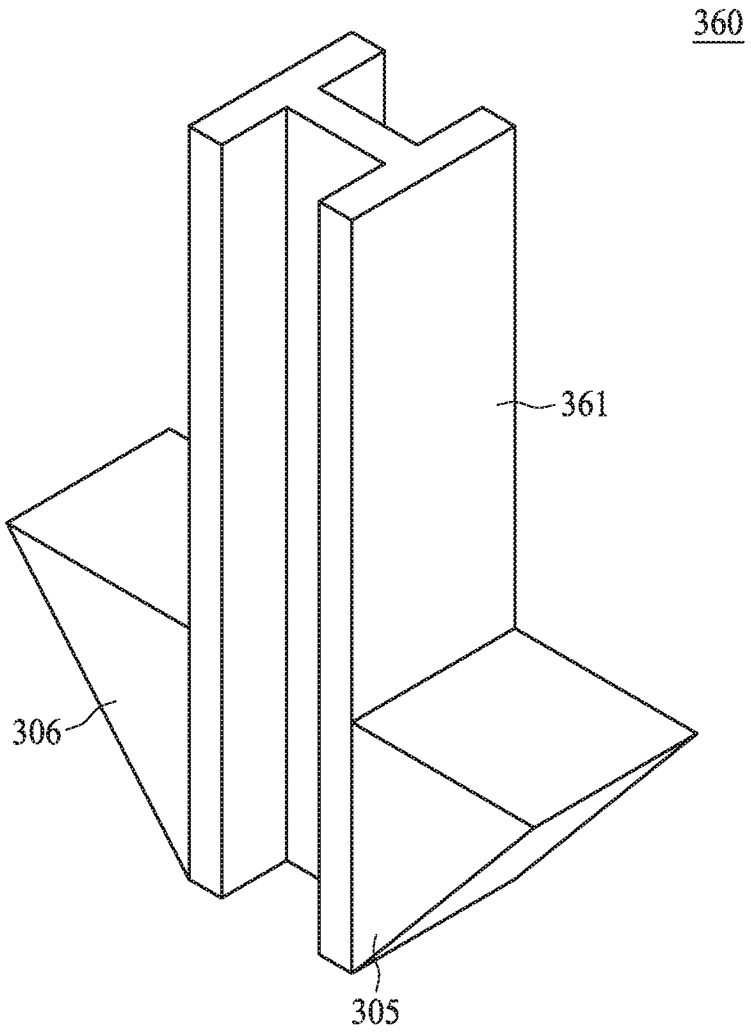
FIG. 3D illustrates a device for fixing a gantry crane rail within a factory building according to an embodiment of the present disclosure.

FIG. 3D illustrates a device for fixing a gantry crane rail in a factory building according to an embodiment of the present disclosure. Referring to FIG. 3D, a fixing device 360 has a structure similar to that of the fixing device 300 shown in FIG. 3A. Referring to FIG. 3D, the main body 361 of the fixing device 360 has an I-shaped cross-section. In some embodiments, the fixing device 360 may include the fixing plate 322 (not shown in FIG. 3D) having a substantially rectangular or square shape as shown in FIG. 3B.

Figure 4A:
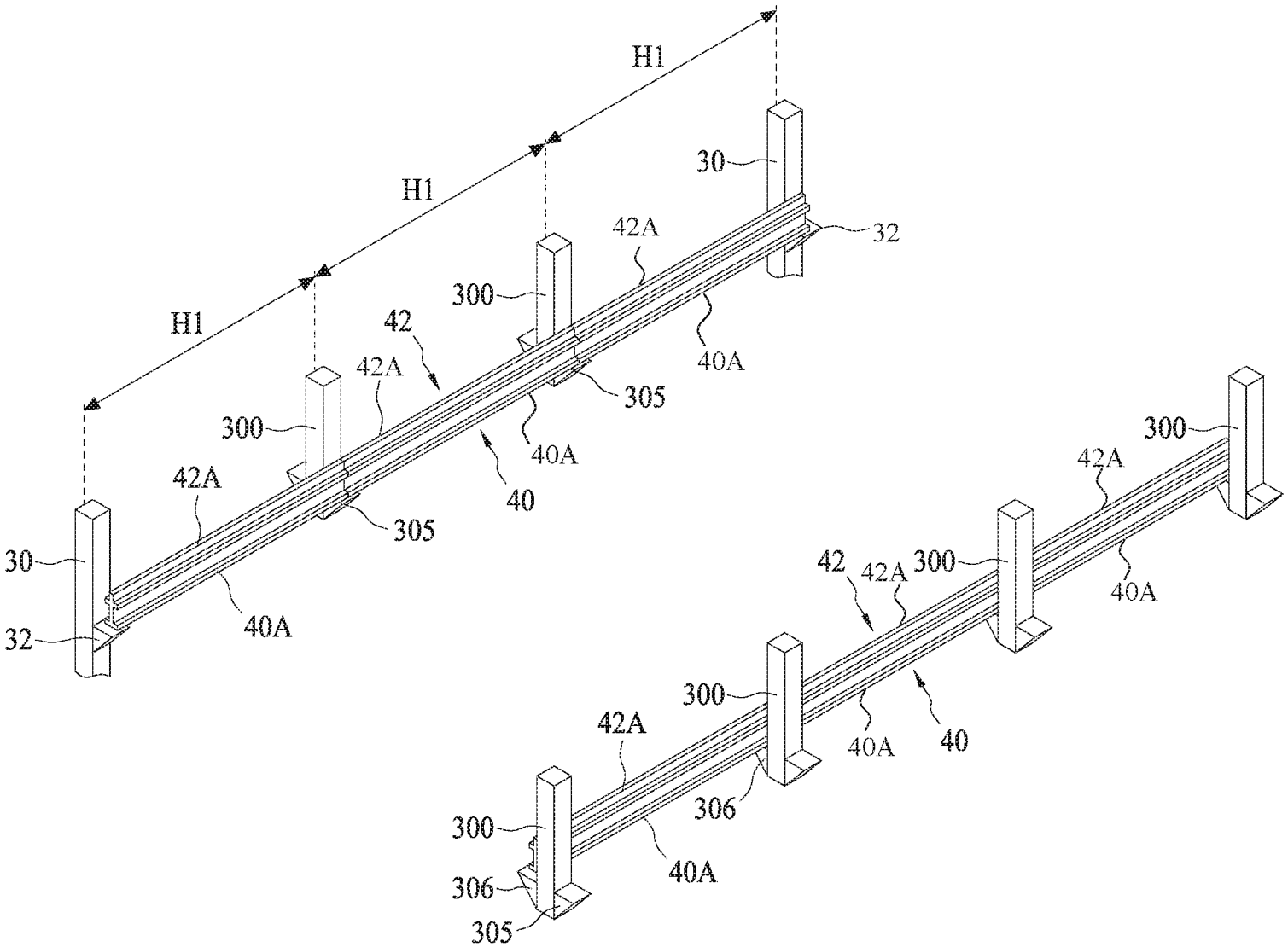
FIG. 4A illustrates an arrangement of gantry crane rails according to an embodiment of the present disclosure.

FIG. 4A illustrates an arrangement of gantry crane rails according to an embodiment of the present disclosure. On the left side of FIG. 4A an arrangement of rails is shown. In some embodiments, two fixing devices 300 are disposed between two pillars 30 with equal distance in between. In some embodiments, one or more fixing devices 300 shown in FIG. 3A may be disposed between two pillars 30 with equal distance in between. In some embodiments, one or more fixing devices 320 shown in FIG. 3B may be disposed between two pillars 30 with equal distance in between. In some embodiments, one or more fixing devices 340 shown in FIG. 3C may be disposed between two pillars 30 with equal distance in between. In some embodiments, one or more fixing devices 360 shown in FIG. 3D may be disposed between two pillars 30 with equal distance in between.

Referring to FIG. 4A, a supporting base 32 is disposed on each of the pillars 30, and each of the fixing devices 300 includes a first protruded support 305 and a second protruded support 306 disposed on two sides of the fixing devices 300. At the left side of FIG. 4A, two fixing devices 300 are provided between two pillars 30 wherein a unit longitudinal beams 40A (at the front) is disposed across the adjacent supporting base 32 and a first protruded support 305, and another unit longitudinal beam 40A (in the middle) is disposed across the adjacent first protruded supports 305, and a further unit longitudinal beam 40A (at the rear) is disposed across the adjacent supporting base 32 and the first protruded support 305. A unit rail 42A is disposed on each of the unit longitudinal beams 40A, and several unit longitudinal beams 40A are connected in series to form a longitudinal beam 40. Several unit rails 42A on the longitudinal beam 40 are connected in series to form a rail 42.

At the right side of FIG. 4A, an arrangement of rails is shown, in which four fixing devices 300 are fixed to a crossbeam (not shown) with equal distance in between. In some embodiments, even numbers of the fixing device 300 shown in FIG. 3A may be used. In some embodiments, even numbers of the fixing device 320 shown in FIG. 3B may be used. In some embodiments, even numbers of the fixing device 340 shown in FIG. 3C may be used. In some embodiments, even numbers of the fixing device 360 shown in FIG. 3D may be used. Each of the fixing devices 300, 320, 340 and 360 includes a first protruded support 305 and a second protruded support 306. Referring to the right side of FIG. 4A, unit longitudinal beams 40A are disposed across adjacent second protruded supports 306. Similar to the arrangement on the left side of FIG. 4A, in the arrangement on the right side of FIG. 4A, a unit rail 42A is disposed on each of the unit longitudinal beams 40A, and several unit longitudinal beams 40A are connected in series to form a longitudinal beam 40. Several unit rails 42A on the longitudinal beam 40 are connected in series to form a rail 42 shown on the right side of FIG. 4A.

In the arrangement of rails shown on the left side of FIG. 4A, the distance between the pillar 30 and the fixing device 300 can be adjusted according to the length of the unit longitudinal beams 40A. In the arrangement of rails shown on the right side of FIG. 4A, the distance between two adjacent fixing devices 300 also can be adjusted according to the length of the unit longitudinal beams 40A. The unit longitudinal beams 40A and the unit rails 42A each have a length H1. In some embodiments, H1 is twelve meters. A gantry crane (not shown) is disposed across two rails 42 shown respectively on the left side and the right side of FIG. 4A.

Conventionally, a unit longitudinal beam can only be disposed on the supporting bases 32 of two adjacent pillars 30. However, as the size of recent factory buildings increases, the distance between two adjacent pillars increases too, making existing unit longitudinal beams unsuitable for use because they are not long enough. It would be costly to customize the length of longitudinal beams for different factory buildings.

The above-mentioned problem can be solved by using the fixing devices 300, 320, 340 and 360 shown in FIGS. 3A-3D. By disposing fixing devices 300, 320, 340 or 360 appropriately under the crossbeam 60 of the factory building, unit longitudinal beams can be disposed with flexibility between a supporting base 32 and a protruded support of the fixing device 300, 320, 340 or 360. As a consequence, existing unit longitudinal beams with a specific length can still be used in the construction of large factory buildings, and thus the applicability of existing unit longitudinal beams is increased.

Figure 4B:
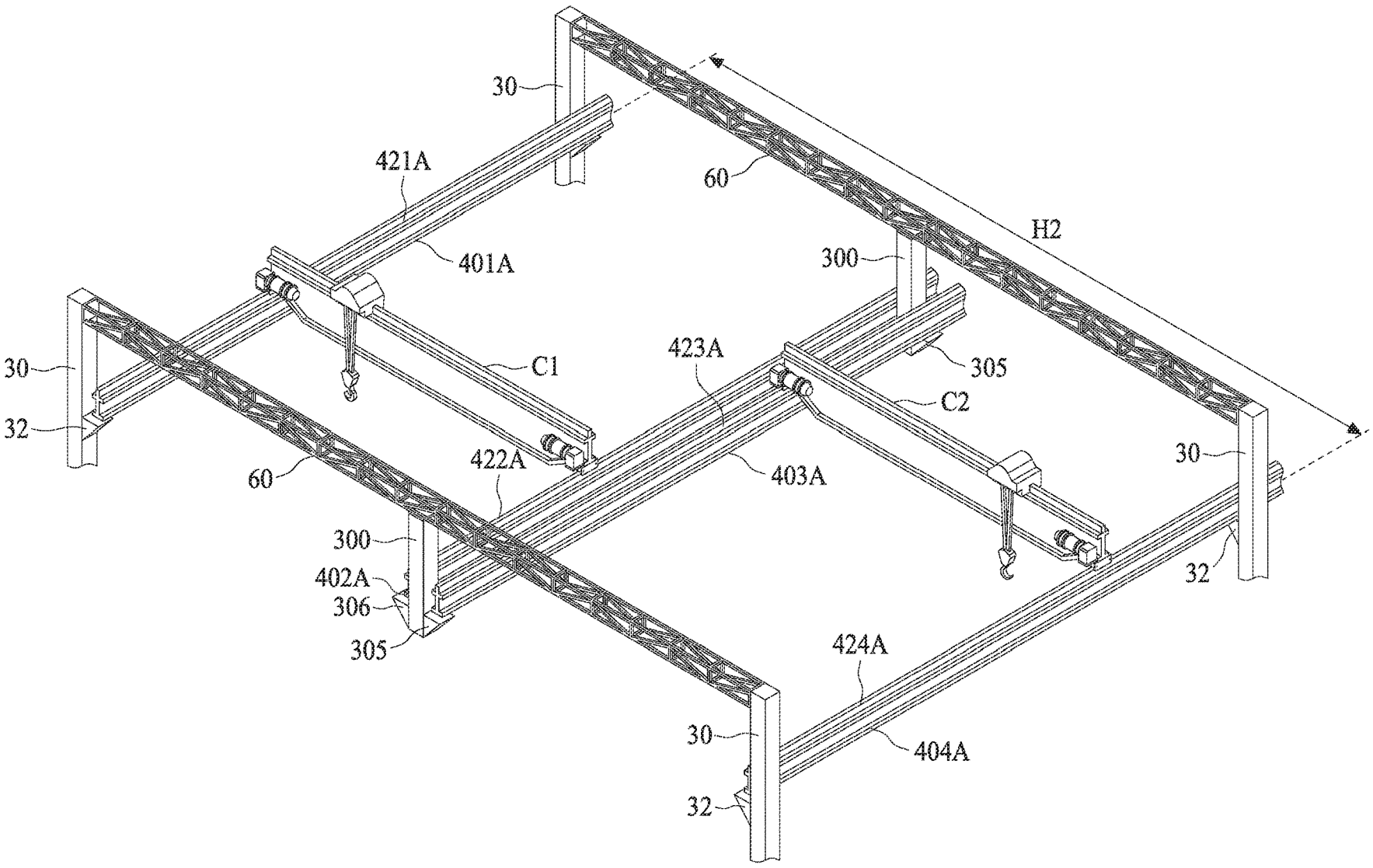
FIG. 4B illustrates an arrangement of gantry crane rails according to an embodiment of the present disclosure.

FIG. 4B illustrates an arrangement of gantry crane rails according to an embodiment of the present disclosure. Referring to FIG. 4B, four unit rails 421A, 422A, 423A and 424A are disposed respectively on four unit longitudinal beams 401A, 402A, 403A and 404A. Unit longitudinal beams 401A, 402A, 403A and 404A are substantially parallel to each other. The unit longitudinal beam 401A is disposed between supporting bases 32 of two pillars 30 on the left side of FIG. 4B. The unit longitudinal beam 402A is disposed between two second protruded supports 306 of two fixing devices 300 fixed to the crossbeam 60. The unit longitudinal beam 403A is disposed between two first protruded supports 305 of two fixing devices 300 fixed to the crossbeam 60. The unit longitudinal beam 404A is disposed between supporting bases 32 of two pillars 30 on the right side of FIG. 4B. As shown in FIG. 4B, gantry cranes C1 and C2 are disposed across two unit rails. For example, the gantry crane C1 is disposed across unit rails 421A and 422A, and the gantry crane C2 is disposed across unit rails 423A and 424A.

Referring to FIG. 4B, the distance between the pillar 30 on the left side for disposing the unit rail 421A and the pillar 30 on the right side for disposing the unit rail 424A is H2 (the total span). In some embodiments, H2 is larger than 30 meters. In some embodiments, H2 is 42 meters, wherein the distance between the unit rails 421A and 422A is around 18 meters and the distance between the unit rails 423A and 424A is around 24 meters.

Conventionally, a longitudinal beam can only be disposed on the supporting bases 32 of two adjacent pillars 30, and a gantry crane is conventionally disposed across longitudinal beams on two ends of the total span (with a distance H2). However, as the size of recent factory buildings increases, the distance H2 increases too, making existing gantry cranes unsuitable for use because their span is not long enough. This problem can be solved by using the fixing devices 300, 320, 340 and 360 shown in FIGS. 3A-3D. By mounting fixing devices 300, 320, 340 or 360 appropriately to the crossbeam 60 of the factory building, longitudinal beams can be disposed with flexibility between a supporting base 32 and a protruded support of the fixing devices 300, 320, 340 or 360. As a consequence, existing gantry cranes with a specific length of span can still be used in the construction of large factory buildings, and thus the applicability of existing gantry cranes is increased.

Figure 5:
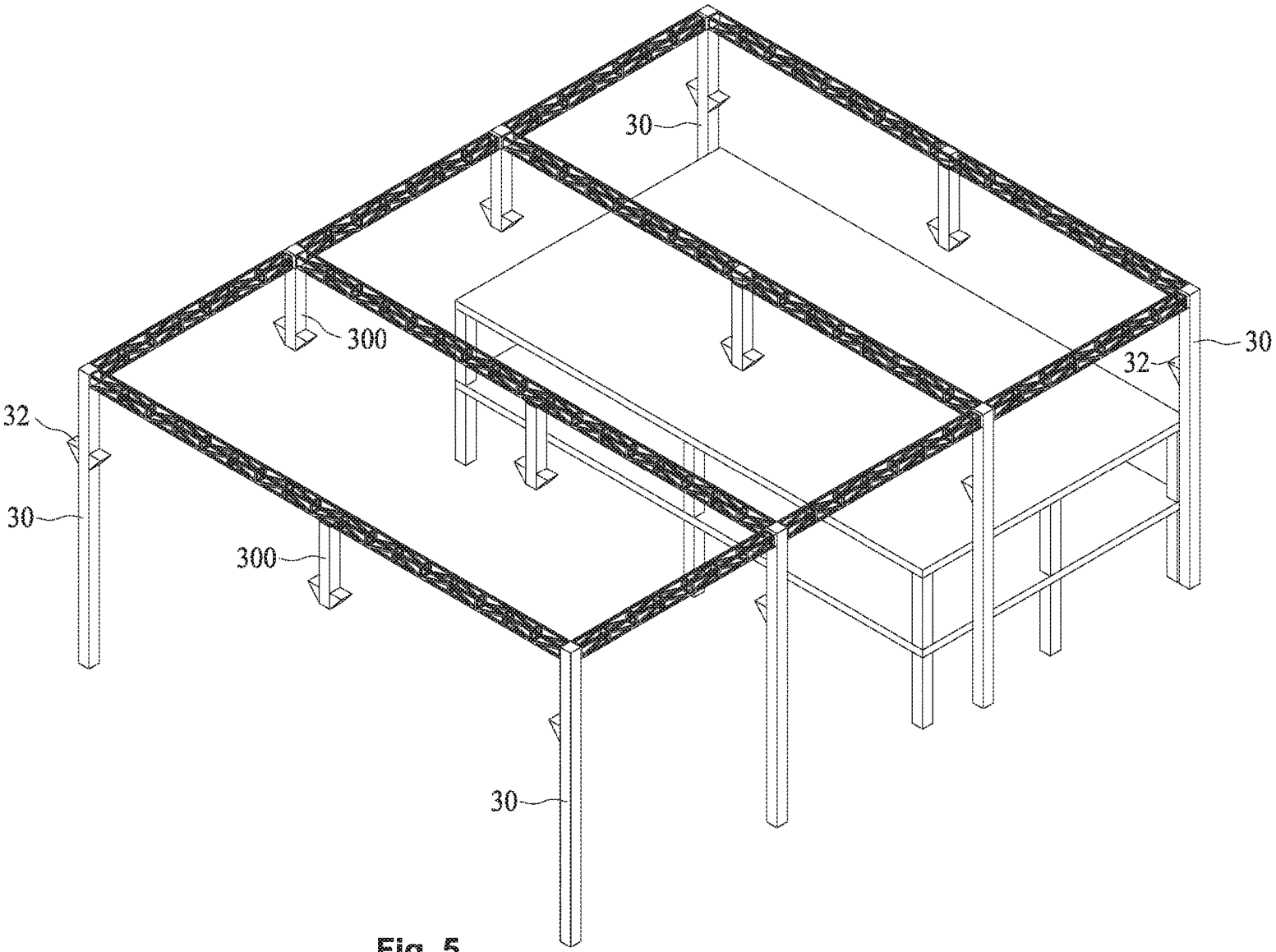
FIG. 5 illustrates a three dimensional view of a gantry crane system used in a factory building according to an embodiment of the present disclosure.

FIG. 5 illustrates a three dimensional view of a gantry crane system used in a factory building according to embodiments of the present disclosure. Referring to FIG. 5, a plurality of pillars 30 are disposed on two sides of the factory building, and each of the pillars includes a supporting base 32. Fixings devices 300, 320, 340 or 360 of FIGS. 3A-3D can be provided at appropriate locations between two pillars 30, and unit longitudinal beams (not shown) and unit rails (not shown) can be disposed with flexibility in the longitudinal direction between two adjacent fixings devices 300, 320, 340 or 360 for two ends of the gantry crane to be placed thereon. In some embodiments, the gantry crane system of FIG. 5 may include multiple sets of the gantry crane rail arrangement shown in FIG. 4A. In some embodiments, the gantry crane system of FIG. 5 may include multiple sets of the gantry crane rail arrangement shown in FIG. 4B. In some embodiments, the gantry crane system of FIG. 5 may include multiple gantry cranes (not shown) disposed across longitudinal beams.

As those of some skill in this art will by now appreciate and depending on the particular application at hand, many modifications, substitutions and variations can be made in and to the materials, apparatus, configurations and methods of use of the devices of the present disclosure without departing from the spirit and scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. A device for fixing a gantry crane rail in a factory building, comprising:
- a main body, comprising:
- a top portion fixed to a bottom surface of a crossbeam of the factory building;
- a first surface,
- a second surface opposite the first surface, and
- a bottom portion, which is free ended, the bottom portion being opposite to the top portion,
- wherein the first surface and the second surface are substantially parallel to the gantry crane rail;
- a first protruded support positioned on the first surface; and
- a second protruded support positioned on the second surface
- wherein both the first protruded support and the second protruded support are substantially in a shape of a triangular prism.

2. The device of claim 1, wherein the main body is a solid cuboid, is a hollow cuboid, or has an I-shaped cross-section.

3. The device of claim 1, further comprising:
- a longitudinal beam disposed on the first protruded support or the second protruded support, wherein the gantry crane rail is disposed on the longitudinal beam.

4. A gantry crane system used in a factory building, comprising:
- a first pillar having a first supporting base;
- a second pillar having a second supporting base;
- a first fixing device;
- a second fixing device;
- a first longitudinal beam disposed between the first supporting base and the second supporting base;
- a second longitudinal beam disposed between the first fixing device and the second fixing device;
- a first rail disposed on the first longitudinal beam;
- a second rail disposed on the second longitudinal beam; and
- a gantry crane disposed across the first rail and the second rail;
- wherein the first longitudinal beam is substantially parallel to the second longitudinal beam; and
- wherein each of the first fixing device and the second fixing device comprises:
- a main body, comprising:
- a top portion fixed to a bottom surface of a crossbeam of the factory building;
- a first surface,
- a second surface opposite the first surface, and
- a bottom portion, which is free ended, the bottom portion being opposite to the top portion,
- wherein the first surface and the second surface are substantially parallel to a moving direction of the gantry crane;
- a first protruded support positioned on the first surface; and
- a second protruded support positioned on the second surface
- wherein both the first protruded support and the second protruded support are substantially in a shape of a triangular prism.

5. The gantry crane system of claim 4, wherein the main body is a solid cuboid, is a hollow cuboid, or has an I-shaped cross-section.

6. The gantry crane system of claim 5, wherein the second longitudinal beam is disposed between the first protruded support of the first fixing device and the first protruded support of the second fixing device.

7. The gantry crane system of claim 4, wherein the top portions of the first fixing device and the second fixing device are fixed to the bottom surface of the crossbeam by means of welding.

8. The gantry crane system of claim 5, wherein the top portions of the first fixing device and the second fixing device each comprise a fixing plate, the fixing plate comprising a plurality of through holes, and wherein each of the first fixing device and the second device is fixed to the bottom surface of the crossbeam with a plurality of screw bolts that pass through the plurality of through holes and that are threadedly connected with threaded holes in the crossbeam.

9. The gantry crane system of claim 4, wherein the gantry crane comprises:

a bearing beam; and a first driving device and a second driving device disposed respectively on two ends of the bearing beam, wherein the first driving device has a first wheel and the second driving device has a second wheel, and the first wheel is movable along the first rail and the second wheel is movable along the second rail.

10. The gantry crane system of claim 4, wherein the first supporting base is substantially in a shape of a triangular prism and fixed to a side of the first pillar, and the second supporting base is substantially in a shape of a triangular prism and fixed to a side of the second pillar.

* * * * *